United States Patent [19]

Tietgen et al.

[11] 4,363,283

[45] Dec. 14, 1982

[54] SUPPORTING PAD FOR HATCH COVERS OF SHIPS

[75] Inventors: Hans P. Tietgen, Seevetal; Gunter Riese, Hamburg, both of Fed. Rep. of Germany

[73] Assignee: Bastian Belzona Verfahrenstechnik, Wolfgang Bastian, Hamburg, Fed. Rep. of Germany

[21] Appl. No.: 233,719

[22] Filed: Feb. 12, 1981

[30] Foreign Application Priority Data

Feb. 21, 1980 [DE] Fed. Rep. of Germany ..... 3006504

[51] Int. Cl.[3] ..... B63B 19/26

[52] U.S. Cl. ..... 114/201 R; 220/228; 220/240; 277/72 FM

[58] Field of Search ..... 114/201 R, 201 A; 277/72 FM; 308/5 R; 220/359, 228, 240

[56] References Cited

U.S. PATENT DOCUMENTS 3,045,631 7/1962 Stransky ..... 114/201 R

FOREIGN PATENT DOCUMENTS 1055988 4/1959 Fed. Rep. of Germany ... 114/201 A
2313459 10/1973 Fed. Rep. of Germany ..... 277/1
2905959 9/1979 Fed. Rep. of Germany ... 114/201 R

*Primary Examiner*—Sherman D. Basinger
*Attorney, Agent, or Firm*—John C. Smith, Jr.

[57] ABSTRACT

A supporting pad for a hatch cover of a ship is provided. The supporting pad comprises a first receptacle firmly connected to the ship. A first slide block is displaceably arranged in the first receptacle. A second receptacle is firmly connected to the hatch cover and a second slide block is displaceably arranged therein. A variable accommodation space is provided at least between the first receptacle and the first slide block. The supporting pad further has an inlet opening oriented toward the variable accommodation space and a pump and a conduit for feeding a volume-stable curable composite material into the variable accommodation space for displacing and adjusting the slide block in the receptacle. By this measure, the bearing surfaces associated with one another are adjusted relative to one another individually.

10 Claims, 5 Drawing Figures

SUPPORTING PAD FOR HATCH COVERS OF SHIPS

BACKGROUND OF THE INVENTION

This invention relates to a supporting pad for a hatch cover of a ship, having a pair of bearing blocks provided with cooperating bearing surfaces and arranged respectively at the rim of a hatch of the ship and at the rim of the hatch cover, a relative movement being performable between the hatch and the hatch cover in a glide plane defined by the bearing surfaces.

Supporting pads of this type have already become known in the art. With the known supporting pads the hatch cover has a sufficient clearance in order to permit a simple opening and closing of the ship hatch. The hatch cover normally engages over the coaming arranged at the rim of the ship hatch. The problem of such supporting pads is that as a result of the relative movements occurring by a straining of the ship during rough sea a satisfactory support pattern of the supporting pads must be obtained. Furthermore, it is required during assembly to individually adjust the cooperating bearing surfaces and weld each bearing block in this adjusted position to the ship or to the hatch cover. It must be kept in mind that because of the prescribed clearance of only 0.5 mm between the upper bearing box and the lower bearing box this work is very costly. If this clearance is not obtained during assembly, the bearing blocks must be reprocessed by building-up welding and grinding or only by grinding.

Furthermore, it is known to form the bearing blocks as supporting pads of steel which are subject to heavy abrasion during use. The deficiency results that steel particles form and rusting occurs upon contact with sea water. As a result of the movements of the ship it does happen that inspite of sealing rust-containing sea water gets into the hatch.

SUMMARY OF THE INVENTION

It is, therefore, an object of the present invention to cause an assembly simplification with simple means for supporting pads for hatch covers of the type described above and to insure a satisfactory supporting pattern.

Another object of the present invention resides in an assembly simplification which at the same time permits the use of high-grade bearing materials economically.

To attain this object the present invention provides a supporting pad for a hatch cover of a ship, having a pair of bearing blocks provided with cooperating bearing surfaces and arranged respectively at the rim of a hatch of the ship and at the rim of the hatch cover, a relative movement being performable between the hatch and the hatch cover in a glide plane defined by the bearing surfaces, said supporting pad comprising a first receptacle firmly connected to the ship; a first slide block displaceably arranged in the first receptacle; a second receptacle firmly connected to the hatch cover; a second slide block displaceably arranged in the second receptacle; a variable accommodation space provided at least between the first receptacle and the first slide block; an inlet opening oriented toward the variable accommodation space, and pump and conduit means for feeding a volume-stable curable composite material into the variable accommodation space for displacing and adjusting said slide block in said receptacle.

This brings about the advantage that the individual adjustment of the slide block by means of supplying composite material is effected with a compulsory displacing of the slide block. The receptacle serves as base and guide, and a high seat accuracy is achieved in a simple manner. This configuration also permits to use relatively little material for high-grade slide blocks and to solve corrosion problems.

In order to permit a bilateral adjustment, it is proposed that the receptacle for the slide block at the ship and the receptacle for the slide block at the hatch cover each have a variable accommodation space for the volume-stable curable composite material suppliable via an inlet opening for the adjustment of the slide block.

In order to eliminate problems occurring when using different metals, it is contemplated that the composite material is a non-corrosive electrically non-conductive material.

Furthermore, it is convenient that the composite material is provided as an adhesive material. According to experience up to date it is possible to use a material as adhesive or composite material as disclosed in the U.S. Pat. No. 4,129,548 and as obtainable under the trade name "BELZONA Ceramic Metal".

In order to avoid the contact of different metals during the supply of the composite material when adjusting the slide blocks, it is provided for that spacers are arranged between each receptacle and its slide block.

So that in case of confined strains no overstraining occurs and hence a tearing open of the hatch cover is prevented even in extreme conditions, it is proposed that at least the slide block arranged at the ship is formed at its side facing the ship as a semi-circular section and its receptacle is preshaped prismatically and by the composite material supplied an adjustment of the slide block and the formation of a bearing shell are performable.

In order to prevent a loss when the hatch cover is lifted off, it is proposed to provide laterally arranged spigots for pivotally arresting the slide block having a semi-circular section.

Furthermore, it is proposed for preventing a joining with the pressed-in composite material that the semi-circular section of the slide block is coated with a separating agent.

Furthermore, for dimensioning the slide blocks, it is proposed that the bearing surface of the slide block at the hatch cover is larger according to the slide path than the associated bearing surface of the slide block arranged at the ship.

For determining the abrasion side, it is proposed that the associated slide blocks are formed by metals having different abrasion resistances.

BRIEF DESCRIPTION OF THE DRAWINGS

Two embodiments of the invention will now be described by way of example and with reference to the accompanying drawings, in which.

DESCRIPTION OF THE PREFERRED EMBODIMENTS

Figure 1:
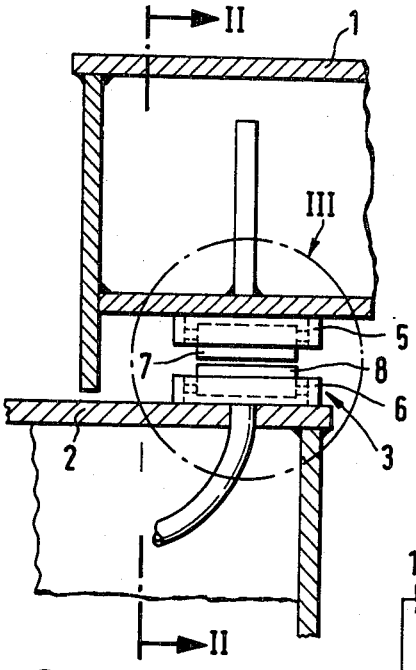
FIG. 1 is a partial sectional view of a supporting pad according to the invention.
Figure 2:
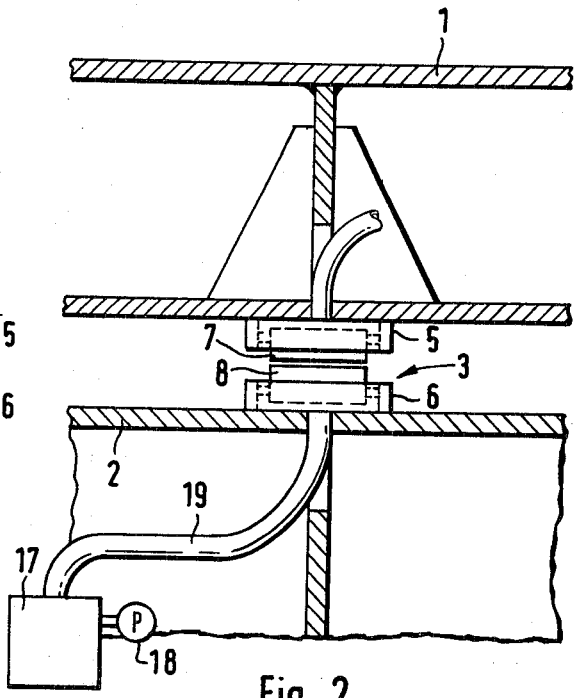
FIG. 2 is a sectional view along the line II—II of FIG. 1.
Figure 3:
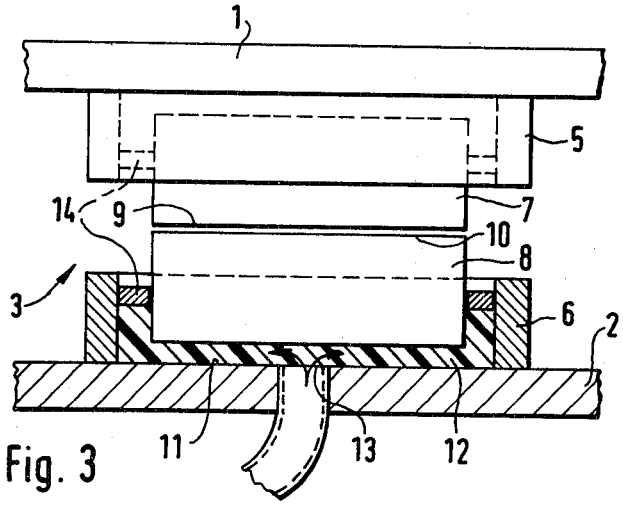
FIG. 3 is an enlarged illustration of a detail III of FIG. 1.

FIGS. 1 to 3 show a hatch cover 1 which is supported at the rim of a hatch of a ship 2 via a plurality of supporting pads 3. Each supporting pad 3 is composed of a receptacle 5 firmly connected to the hatch cover 1 and a receptacle 6 firmly connected to the ship 2. A slide block 7 having a bearing surface 9 is accommodated in the receptacle 5, and a slide block 8 having a bearing surface 10 is accommodated in the receptacle 6. Each of the receptacles 5 and 6 is formed as a guide in the nature of a box for its slide block and has an accommodation space 11 into which a composite material 12 is suppliable via an inlet opening 13 such that the slide blocks 7 and 8 in the receptacles 5 and 6 are piston-like shiftable and adjustable depending on the filled-in volume of composite material 12. In order to align the receptacles 5 and 6 and the slide blocks 7 and 8 relative to one another, spacers 14 are provided. Among other things the formation of electrical elements is thereby avoided when using different metals.

Conveniently, now all slide blocks 7 of the hatch cover 1 are able to be brought to level possibly in a workshop by means of the pressed-in composite material 12. Upon being placed onto the slide blocks 8 of the ship, these slide blocks 8 are pressed against the slide blocks 7 by pressing in composite material 12 via the inlet opening 13. Thereby, it is possible to precisely correlate the bearing surfaces 9 and 10 and to obtain proper supporting pads 3.

Figure 5:
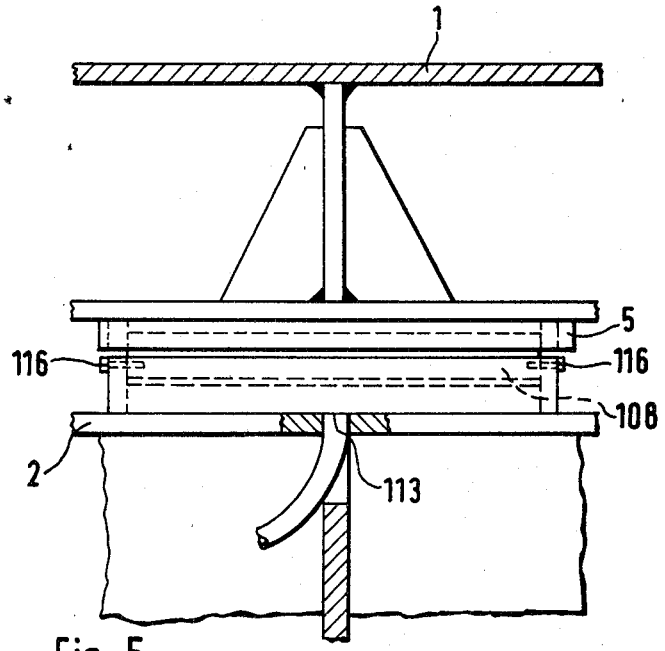
FIG. 5 is a side elevational view of the embodiment of FIG. 4.
Figure 4:
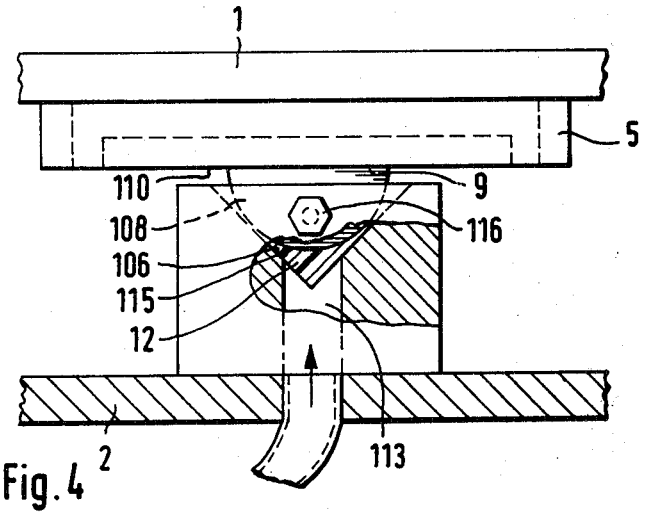
FIG. 4 is a front elevational view of a further embodiment with a portion of the bearing shell shown in section.

In the embodiment of FIGS. 4 and 5, alternatively the slide block 108 of the ship 2 is formed as a semi-circular section, and the receptacle 106 of the ship 2 is preshaped prismatically. The configuration at the hatch cover 1 is provided in the manner described hereinbefore. The receptacle 106 of the ship 2 is likewise able to be supplied with a composite material 12 via an inlet opening 113 so that an adjustment of the slide block 108 is effected and a bearing shell 115 is formed. In order to not permit a firm connection to the composite material 12, the slide block 108 is coated with a separating agent. After adjustment, the bearing surface 9 of the slide block 7 and the bearing surface 110 of the slide block 108 oppose each other, a deflection movement of the slide block 108 being able to be effected in the bearing shell 115 in the event of a confined straining. In order to hold the slide block 108 in the bearing shell 115 even when the hatch cover 1 is not applied, spigots 116 in the form of pivot spigots are laterally arranged which maintain rotability.

Preferably, the composite material 12 according to FIGS. 1 to 3 at the same time has an adhesive function so that the slide blocks 7 and 8 are accordingly arrested in their receptacles 5 and 6.

It is contemplated to form the slide blocks of a metl such as bronze, CrNi steel or titanium steel and to thus permit satisfactory conditions.

The feeding of the composite material 12 which is volume-stable and curable is effected in a conventional manner from a material container 17 via a pump 18 which is selectively connected via a conduit 19 to the inlet opening.

The invention may be embodied in other specific forms without departing from the spirit or essential characteristics thereof. The embodiments are therefore to be considered in all respects as illustrative and not restrictive.

What is claimed is:

1. A supporting pad for a hatch cover of a ship, having a pair of bearing blocks provided with cooperating bearing surfaces and arranged respectively at the rim of a hatch of the ship and at the rim of the hatch cover, a relative movement being performable between the hatch and the hatch cover in a glide plane defined by the bearing surfaces, said supporting pad comprising (a) a first receptacle (6,106) firmly connected to the ship;

(b) a first slide block (8,108) displaceably arranged in the first receptacle;

(c) a second receptacle (5) firmly connected to the hatch cover (1);

(d) a second slide block (7) displaceably arranged in the second receptacle;

(e) a variable accommodation space (11) provided at least between the first receptacle (6,106) and the first slide block (8,108);

(f) an inlet opening (13,113) oriented toward the variable accommodation space (11), and (g) pump and conduit means for feeding a volume-stable curable composite material (12) into the variable accommodation space (11) for displacing and adjusting said slide block in said receptacle.

2. A supporting pad as set forth in claim 1, wherein the receptacle for the slide block at the ship and the receptacle for the slide block at the hatch cover each have a variable accommodation space for the volume-stable curable composite material suppliable via an inlet opening for the adjustment of the slide block.

3. A supporting pad as set forth in claim 1, wherein the composite material is a non-corrosive electrically non-conductive material.

4. A supporting pad as set forth in claim 1, wherein the composite material is provided as an adhesive material.

5. A supporting pad as set forth in claim 1, wherein spacers are arranged between each receptacle and its slide block.

6. A supporting pad as set forth in claim 1, wherein at least the slide block arranged at the ship is formed at its side facing the ship as a semi-circular section and its receptacle is preshaped prismatically, and wherein the composite material supplied by said pump and conduit means to said variable acommodation space to adjust the slide block forms a bearing shell supporting said slide block.

7. A supporting pad as set forth in claim 6, wherein laterally arranged spigots for pivotally arresting the slide block having a semi-circular section are provided.

8. A supporting pad as set forth in claim 6, wherein the semi-circular section of the slide block is coated with a separating agent.

9. A supporting pad as set forth in claim 1, wherein the bearing surface of the slide block at the hatch cover is larger according to the slide path than the associated bearing surface of the slide block arranged at the ship.

10. A supporting pad as set forth in claim 1, wherein the slide blocks associated with one another are formed of metals having different abrasion resistances.

* * * * *